US006481958B1

(12) United States Patent
Wilhelm et al.

(10) Patent No.: US 6,481,958 B1
(45) Date of Patent: Nov. 19, 2002

(54) SIDE CHANNEL PUMP

(75) Inventors: Hans-Dieter Wilhelm, Neu-Anspach (DE); Holger Barth, Friedewald (DE); Matthias Stabb, Alheim (DE)

(73) Assignee: Mannesmann Vdo AG, Frankfurt am Main (DE)

( * ) Notice: Subject to any disclaimer, the term of this patent is extended or adjusted under 35 U.S.C. 154(b) by 0 days.

(21) Appl. No.: 09/831,685

(22) PCT Filed: Aug. 26, 2000

(86) PCT No.: PCT/EP00/08334

§ 371 (c)(1),
(2), (4) Date: Jul. 26, 2001

(87) PCT Pub. No.: WO01/20169

PCT Pub. Date: Mar. 22, 2001

(30) Foreign Application Priority Data

Sep. 10, 1999 (DE) ..... 199 43 261

(51) Int. Cl.[7] ..... F04B 15/00
(52) U.S. Cl. ..... 415/55.1
(58) Field of Search ..... 415/55.1, 55.2, 415/55.3, 55.4, 55.5, 55.6, 55.7, 121.2, 169.1

(56) References Cited

U.S. PATENT DOCUMENTS 5,921,746 A 7/1999 Yu et al.

FOREIGN PATENT DOCUMENTS

| | | | |
|---|---|---|---|
| DE | 40 20 521 A1 | 1/1992 | ..... F04D/5/00 |
| DE | 196 15 322 A1 | 10/1997 | ..... F04D/5/00 |
| DE | 197 49 404 C1 | 5/1999 | ..... F04D/5/00 |
| WO | WO 92/00457 | 9/1992 | ..... F04D/5/00 |

OTHER PUBLICATIONS

Abstract of Japan reference 09079168A (Mar. 25, 1997).

*Primary Examiner*—F. Daniel Lopez
*Assistant Examiner*—J M McAleenan
(74) *Attorney, Agent, or Firm*—David M. Thimmig; Mayer Brown Rowe & Maw

(57) ABSTRACT

In a feed pump designed as a side-channel pump, a blade chamber of an impeller has a contour which is formed by a radius and in which, as seen from the contour, the origin of the radius is located behind a center line of the blade chamber. A circulation flow thereby passes into the blade chamber with particularly low turbulences. The feed pump has particularly high efficiency as a result.

11 Claims, 2 Drawing Sheets

SIDE CHANNEL PUMP

BACKGROUND OF THE INVENTION

The invention relates to a feed pump with a driven impeller which rotates in a pump casing and has in its end faces at least one ring of guide blades delimiting blade chambers and in which the blade chambers have an inflow region and an outflow region for the medium to be fed, and with at least one part-annular channel which is arranged in the region of the guide blades in the pump casing and which forms with the blade chambers a feed chamber from an inlet channel to an outlet channel, the contour of the blade chambers being formed by at least one radius with an origin within the feed chamber.

Such feed pumps are often used for feeding fuel in a fuel tank or for feeding washing fluid in a shield washing system of a motor vehicle and are known from practice. The known feed pump has a ring of blade chambers in each of the two end faces of the impeller. The blade chambers are delimited in the radially outer direction by a straight wall arranged perpendicularly to the end faces of the impeller. The contour of the blade chambers which points in the radially inner direction of the impeller is generated by a radius. The origin of the radius is located on the center line arranged perpendicularly to the end faces of the impeller. This origin is at the same time the origin of a second radius forming the part-annular channel.

One disadvantage of the known feed pump is that it generates turbulences in the medium to be fed. These turbulences lead to the feed pump having low efficiency. Moreover, in the case of media which are near the boiling point, such as, for example, hot gasoline fuel, there is the risk that vapor bubbles will be formed within the feed chamber. The vapor bubbles lead to a sharp reduction in the volume flow fed by the feed pump.

SUMMARY OF THE INVENTION

The problem on which the invention is based is to design a feed pump of the type initially mentioned, in such a way that it has as high an efficiency as possible and reliably prevents the formation of vapor bubbles.

This problem is solved, according to the invention, in that, as seen from the blade chamber contour determined by the radius, the origin of the radius is located in the region opposite a center line of the blade chamber, said center line running perpendicularly to the end face of the impeller.

By virtue of this design, the blade chamber has, in its region formed by the radius, a contour which ascends at a very low inclination. A circulation flow in the feed chamber alternates between the impeller and the pump casing via this low-inclination contour. Since the circulation flow undergoes only slight deflection in this region, the risk of turbulences is kept particularly low. The formation of vapor bubbles is also avoided as a result.

According to an advantageous development of the invention, the impeller can be manufactured cost-effectively if the origins of a plurality of radii for blade chamber contours opposite one another are located on a common plane within the impeller, said plane running parallel to the end face of the impeller.

Turbulences often occur in the region in which the circulation flow alternates between the blade chamber and the part-annular channel. According to another advantageous development of the invention, the circulation flow set in turbulence here can be calmed again quickly if, from the plane running parallel to the end face of the impeller as far as the end face, the blade chambers have, in their regions adjacent to the guide blades, boundaries guided perpendicularly to the end face of the impeller.

According to another advantageous development of the invention, the impeller has simply constructed blade chambers and can therefore be manufactured particularly cost-effectively if the origins of two radii generating in each case contours opposite one another are arranged mirror-symmetrically to the center line of the blade chamber. As a result, the center line can be designed as a bisecting line for the contour pointing toward the center of the impeller and for the contour pointing away from the center of the impeller.

The feed pump according to the invention has particularly high efficiency if the distance of the origins of the radii from the center line is approximately the same amount as their distance from the end face.

As in the known feed pump, blade chambers arranged opposite one another could be connected to one another in a radially outer region of the impeller. However, a contribution to a further increase in the efficiency of the feed pump according to the invention is made if blade chambers arranged opposite one another mirror-symmetrically in the two end faces of the impeller are connected to one another solely in the region of the center line. The circulation flow can thereby flow from one feed chamber over into the other feed chamber with particularly low turbulences. Moreover, the risk of the formation of vapor bubbles is likewise kept particularly low as a result.

BRIEF DESCRIPTION OF THE DRAWINGS

The invention permits numerous embodiments. In order to make its basic principle even clearer, one of these is illustrated in the drawing and is described below. In the drawing.

DETAILED DESCRIPTION OF THE PREFERRED EMBODIMENT

Figure 1:
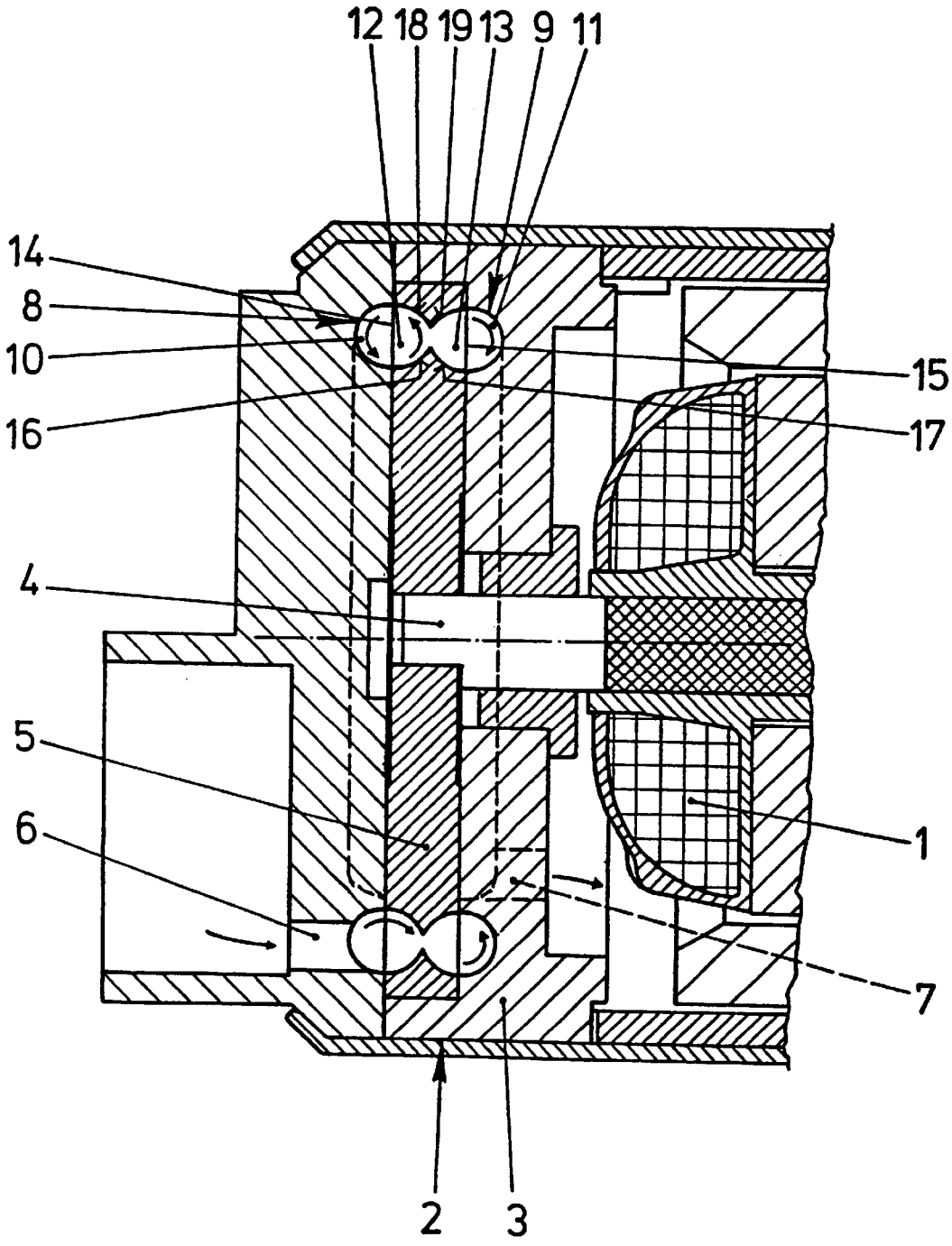
FIG. 1 shows a sectional illustration through a feed pump according to the invention.

FIG. 1 shows a longitudinal section through a feed pump 2 which is driven by an electric motor 1 and is designed as an axial-throughflow side-channel pump and which may be provided, for example, for feeding fuel out of a fuel tank, not illustrated, of a motor vehicle. The feed pump 2 has a pump casing 3, in which is arranged an impeller 5 fastened fixedly in terms of rotation on a shaft 4 of the electric motor 1.

The pump casing 3 has an inlet channel 6 on its face facing away from the electric motor 1 and an outlet channel 7 on the side facing the electric motor 1. The inlet channel 6 opens into a feed chamber 8. A second feed chamber 9 opens into the outlet channel 7. The feed chambers 8, 9 have in each case part-annular channels 10, 11 incorporated in the pump casing 3 and blade chambers 12, 13 arranged in the impeller 5. The blade chambers 12, 13 are delimited in each case by guide blades 14, 15 and in each case have an inflow region 16, 17 for the inflow of the medium to be fed and an outflow region 18, 19.

Blade chambers 12, 13 opposite one another are connected to one another between the inflow region 16, 17 and the outflow region 18, 19. When the impeller 5 rotates, circulation flows occur in each case in the feed chambers 8, 9. A part stream is branched off from the circulation flow of the inlet-side feed chamber 8 and flows over into the outlet-side feed chamber 9. The flows are identified by arrows in the drawing.

Figure 2:
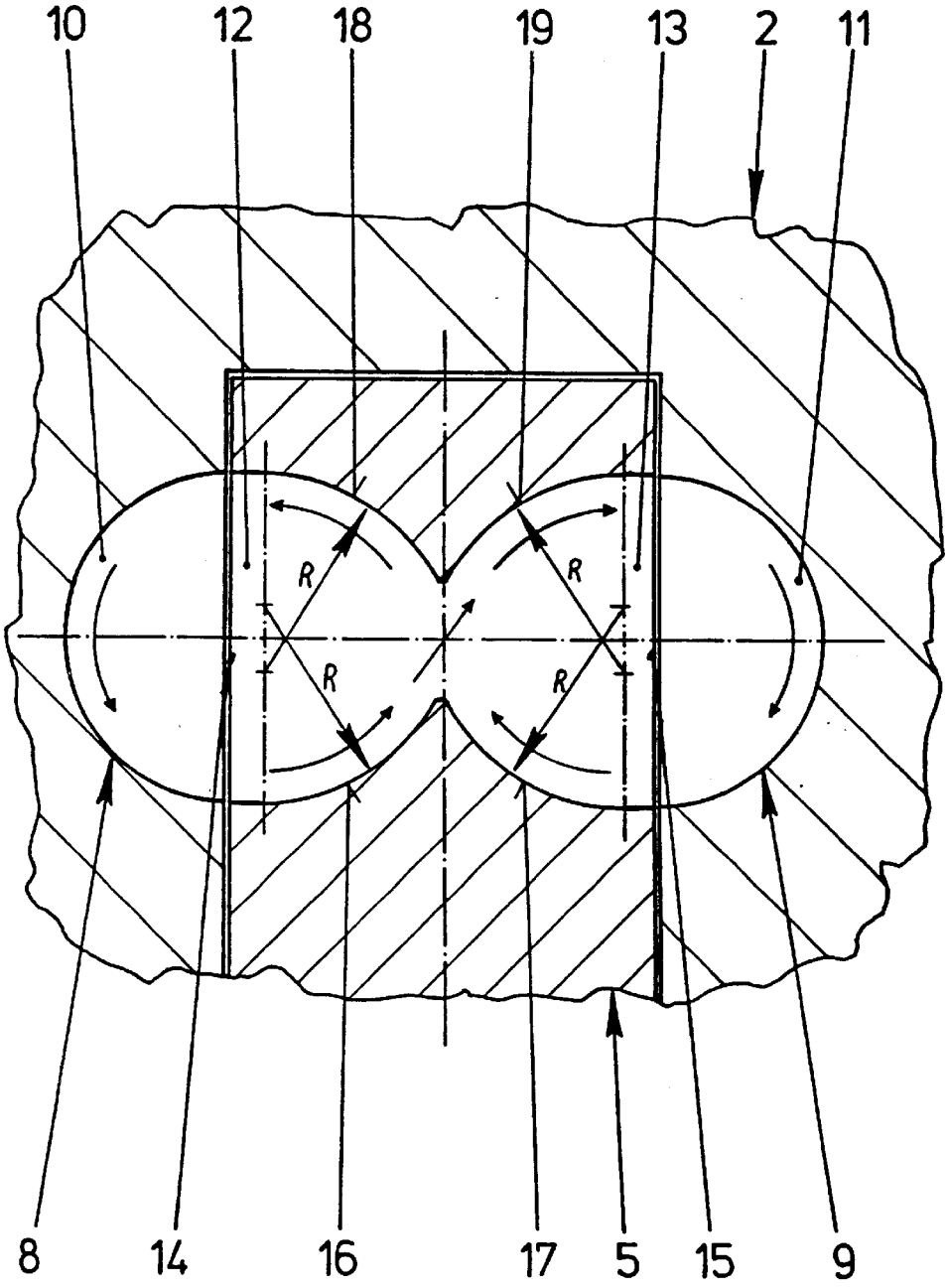
FIG. 2 shows an enlarged illustration of the feed pump from FIG. 1 in the region of feed chambers.

FIG. 2 shows, greatly enlarged, the feed pump 2 from FIG. 1 in the region of the feed chambers 8, 9. It can be seen, here, that the blade chambers 12, 13 are in each case designed symmetrically to a center line running perpendicularly to one end face. The blade chambers 12, 13 have, in the inflow regions 16, 17 and in the outflow regions 18, 19, in each case a contour formed by radii R. The radii R have, in this case, an origin located behind the center line, as seen from the respective contour. Moreover, the origins of the radii R are located in a common plane arranged parallel to the end face of the impeller 5. For clarity, the planes of the blade chambers 12, 13 are illustrated by dashes and dots in the drawing. As a result, the circulation flow passes from the part-annular channels 10, 11 into the blade chambers 12, 13 with particularly low turbulences. The plane of the origins of the radii R is at approximately the same distance from the end face of the impeller 5 as the origins of the radii R are from the center line.

Although reference has been made, for the purpose of explanation, to a preferred embodiment of a feed pump, it should be understood that any of a variety of components and suitable materials of construction and dimensions may be used to satisfy the particular needs and requirements of the end user. It will be apparent to those skilled in the art that modifications and variations can be made in the design and construction of the feed pump without departing from the scope or spirit of the invention. Other embodiments of the invention will be apparent to those skilled in the art from consideration of the specification and practice of the invention disclosed herein.

What is claimed is:

1. A feed pump with a driven impeller which rotates in a pump casing and has in two end faces at least one ring of guide blades delimiting blade chambers and in which the blade chambers have an inflow region and an outflow region for a medium to be fed, and with at least one part-annular channel which is arranged in the region of the guide blades in the pump casing and which forms with the blade chambers a feed chamber from an inlet channel to an outlet channel, a contour of the blade chambers being formed by at least one radius with an origin within the feed chamber, wherein, as seen from the blade chamber contour determined by the radius, an origin of the radius is located in a region on a side of a center line of the blade chamber opposite the contour said center line running perpendicularly to an end face of the impeller.

2. The feed pump of claim 1, wherein origins of a plurality of radii for blade chamber contours opposite one another are located on a common plane within the impeller, said plane running parallel to the end face of the impeller.

3. The feed pump of claim 2, wherein the distance of the origins of the radii from the center line is approximately the same as the distance of the origins of the radii from the end face.

4. The feed pump of claim 2, wherein the blade chambers are arranged opposite one another mirror-symmetrically in the two end faces of the impeller and are connected to one another solely in a region proximate the center line.

5. The feed pump of claim 2, wherein from the plane running parallel to the end face of the impeller as far as the end face, the blade chambers have, in regions adjacent to the guide blades, boundaries guided perpendicularly to the end face of the impeller.

6. The feed pump of claim 5, wherein origins of two radii generating in each case contours opposite one another are arranged mirror-symmetrically to the center line of the blade chambers.

7. The feed pump of claim 1, wherein origins of two radii generating in each case contours opposite one another are arranged mirror-symmetrically to the center line of the blade chambers.

8. The feed pump of claim 6, wherein the distance of the origins of the radii from the center line is approximately the same as the distance of the origins of the radii from the end face.

9. The feed pump of claim 1, wherein the distance of the origins of the radii from the center line is approximately the same as the distance of the origins of the radii from the end face.

10. The feed pump of claim 8, wherein blade chambers are arranged opposite one another mirror-symmetrically in the two end faces of the impeller and are connected to one another solely in a region proximate the center line.

11. The feed pump of claim 1, wherein blade chambers are arranged opposite one another mirror-symmetrically in the two end faces of the impeller and are connected to one another solely in a region proximate the center line.

* * * * *